US008629787B1

(12) United States Patent
Rathinam et al.

(10) Patent No.: US 8,629,787 B1
(45) Date of Patent: Jan. 14, 2014

(54) SYSTEM, MODULE, AND METHOD FOR PRESENTING CLEARANCE-DEPENDENT ADVISORY INFORMATION IN AN AIRCRAFT

(75) Inventors: Sethu R. Rathinam, Cedar Rapids, IA (US); Joel M. Wichgers, Urbana, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 266 days.

(21) Appl. No.: 13/115,423

(22) Filed: May 25, 2011

(51) Int. Cl.
*G08B 23/00* (2006.01)

(52) U.S. Cl.
USPC ..... 340/963; 701/14; 701/120; 342/36

(58) Field of Classification Search
USPC ..... 340/963; 701/14, 17, 120; 342/29, 30, 342/36
See application file for complete search history.

(56) References Cited

U.S. PATENT DOCUMENTS

| | | | | |
|---|---|---|---|---|
| 6,085,150 | A * | 7/2000 | Henry et al. | 701/301 |
| 6,304,800 | B1 * | 10/2001 | Ishihara et al. | 701/16 |
| 6,314,363 | B1 * | 11/2001 | Pilley et al. | 701/120 |
| 6,690,296 | B2 * | 2/2004 | Corwin et al. | 340/961 |
| 6,873,269 | B2 * | 3/2005 | Tran | 340/961 |
| 7,215,256 | B2 * | 5/2007 | Reusser et al. | 340/975 |
| 2005/0156777 | A1 * | 7/2005 | King et al. | 342/29 |
| 2006/0265109 | A1 * | 11/2006 | Canu-Chiesa et al. | 701/3 |
| 2008/0114504 | A1 * | 5/2008 | Goodman et al. | 701/3 |
| 2009/0322586 | A1 * | 12/2009 | Lanzkron | 342/36 |
| 2010/0292871 | A1 * | 11/2010 | Schultz et al. | 701/3 |
| 2010/0324755 | A1 * | 12/2010 | Zammit-Mangion | 701/3 |
| 2011/0046869 | A1 * | 2/2011 | Goodman et al. | 701/120 |
| 2011/0231096 | A1 * | 9/2011 | Ridenour, II | 701/301 |
| 2011/0282582 | A1 * | 11/2011 | Stayton et al. | 701/301 |
| 2012/0158219 | A1 * | 6/2012 | Durling et al. | 701/4 |
| 2012/0245835 | A1 * | 9/2012 | Weitz et al. | 701/120 |

OTHER PUBLICATIONS

Joint Planning and Development Office, "Concept of Operations for the Next Generation Air Transportation System", Sep. 30, 2010, version 3.2.

* cited by examiner

*Primary Examiner* — Hai Phan
*Assistant Examiner* — Zhen Y Wu
(74) *Attorney, Agent, or Firm* — Donna P. Suchy; Daniel M. Barbieri

(57) ABSTRACT

A present novel and non-trivial system, module, and method for presenting clearance-dependent advisory information in an aircraft is disclosed. Clearances include those corresponding to interval management operations and/or trajectory management operations. Data representative of clearance information including data representative of an actual controller intervention threshold ("CIT") information, ownship information, target information, and alert parameter(s) information is received. The actual CIT information is comprised of the CIT of a clearance assigned to an aircraft and/or an designator from which the CIT of the assigned clearance is determined. A dynamic alerting threshold is determined as a function of the received information. If the ownship position meets or exceeds the alerting threshold, an advisory data set comprised of visual advisory information, aural advisory information, and/or tactile advisory information is generated and provided a presentation system in which advisory and/or alert information is presented by an applicable unit of the presentation system.

20 Claims, 10 Drawing Sheets

SYSTEM, MODULE, AND METHOD FOR PRESENTING CLEARANCE-DEPENDENT ADVISORY INFORMATION IN AN AIRCRAFT

BACKGROUND OF THE INVENTION

1. Field of the Invention

This invention pertains generally to the field of aviation which manages or generates interval management data or trajectory management data for an aircraft in flight.

2. Description of the Related Art

In the United States ("U.S."), preparations have begun to implement the Next Generation Air Transport System ("NextGen"), a system designed to reduce the stress currently experienced by the U.S and address the expected growth in aircraft operations forecasted through 2025. A Concept of Operations ("ConOps") developed for NextGen identified many NextGen capabilities which detail the overall effect desired through the implements of specific standards, processes, and conditions. One of these identified capabilities is an air traffic management ("ATM") capability known as Efficient Trajectory Management, which provides the ability to assign trajectories that minimize the frequency and complexity of aircraft conflicts through the negotiation and adjustment of individual aircraft trajectories and/or sequences when required by resource constraints.

The ConOps has stated that the roles of flight operators will change as NextGen is developed to provide a collaborative ATM in which the flight crew of the aircraft will be delegated more of the spacing responsibility or both spacing and separation responsibilities that is or are currently being performed by the air navigation service providers ("ANSP") such as air traffic controllers. Under the delegated operations, the responsibility for spacing between designated aircraft or the responsibilities for both spacing and separation between designated aircraft will transfer from the ANSP to the flight crew, such that the ANSP will intervene at times when the controller no longer believes the flight crew of the aircraft can maintain the assigned spacing or a safe separation interval between the aircraft and its designated target aircraft as assigned in a clearance. To avoid controller intervention, a clearance-dependent advisory information can be presented to the pilot.

BRIEF SUMMARY OF THE INVENTION

A present novel and non-trivial system, module, and method for presenting clearance-dependent advisory information for an aircraft in flight is disclosed herein. As disclosed herein, a presentation system may present advisory information corresponding to a first level of threat or second level of threat to a visual display unit, an aural alerting unit where the advisory information is aural advisory information, and/or to a tactile advisory unit after a threshold advisory ("TA") generator has received clearance data, target data, ownship data, and alert parameter data; determined a dynamic alerting threshold as a function of the preceding data; and generated an advisory data set when ownship position meets or exceeds the dynamic alerting threshold.

In one embodiment, a system for presenting clearance-dependent advisory information for an aircraft in flight is disclosed. The system may be comprised of ownship data source, a target data source, a clearance data source, an alert parameter data source, a TA generator, and a presentation system. The TA generator is programmed or configured to receive data from the preceding four sources, determine a dynamic alerting threshold as a function of the data, generate an advisory data set when ownship position meets or exceeds the dynamic alerting threshold, and provide the advisory data set to the presentation system. As embodied herein, clearance data may represent spacing clearance data or trajectory clearance data representative of actual controller intervention threshold information of a clearance assigned to ownship; the target data may correspond to the clearance data and represent target aircraft information or target waypoint information; the ownship data may represent at least the position of ownship; and the alert parameter data may represent one or more alert parameters. After receiving the advisory data set, the presentation system may present advisory information corresponding to a first level of threat or second level of threat to a visual display unit where the advisory information is visual advisory information, to an aural alerting unit where the advisory information is aural advisory information, and/or to a tactile advisory unit where the advisory information is tactile advisory data.

In another embodiment, a module for presenting clearance-dependent advisory information for an aircraft in flight is disclosed. The module may be comprised of an input communications interface to facilitate a providing of data by at least one of the four preceding data sources, an output communications interface to facilitate a providing of an advisory data set to the presentation system, and the TA generator that is programmed or configured to receive data from the preceding four sources, determine a dynamic alerting threshold as a function of the data, generate an advisory data set when ownship position meets or exceeds the dynamic alerting threshold, and provide the advisory data set to the presentation system as discussed above.

In another embodiment, a method for presenting clearance-dependent advisory information for an aircraft in flight is disclosed. As discussed above, the TA generator may perform the method by receiving clearance data, target data, ownship data, and alert parameter data; determining a dynamic alerting threshold as a function of the data; generating an advisory data set when ownship position meets or exceeds the dynamic alerting threshold; and providing the advisory data set to the presentation system.

Figure 2A:
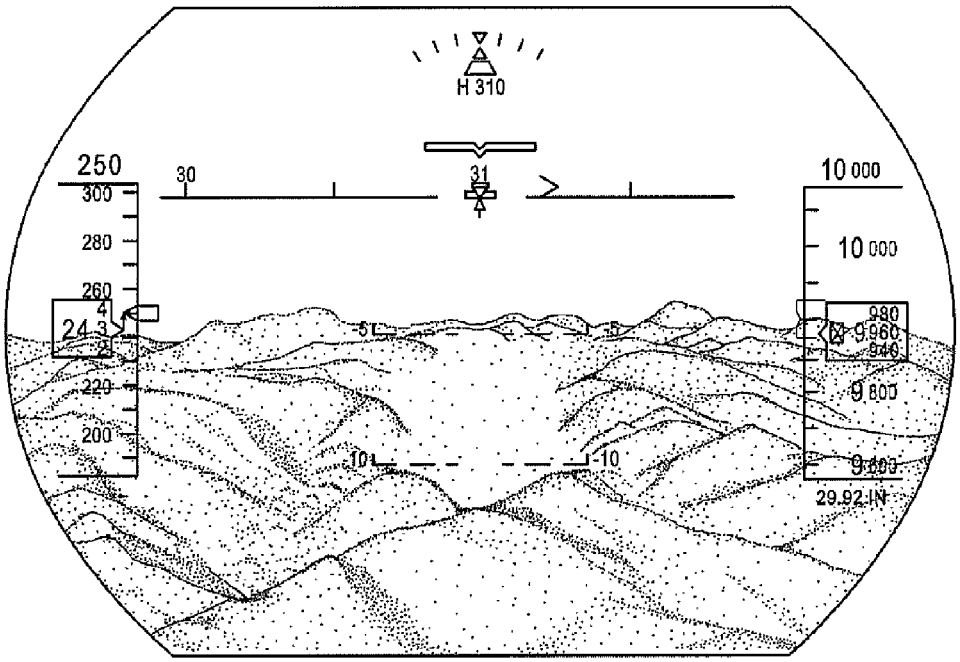
Figure 2B:
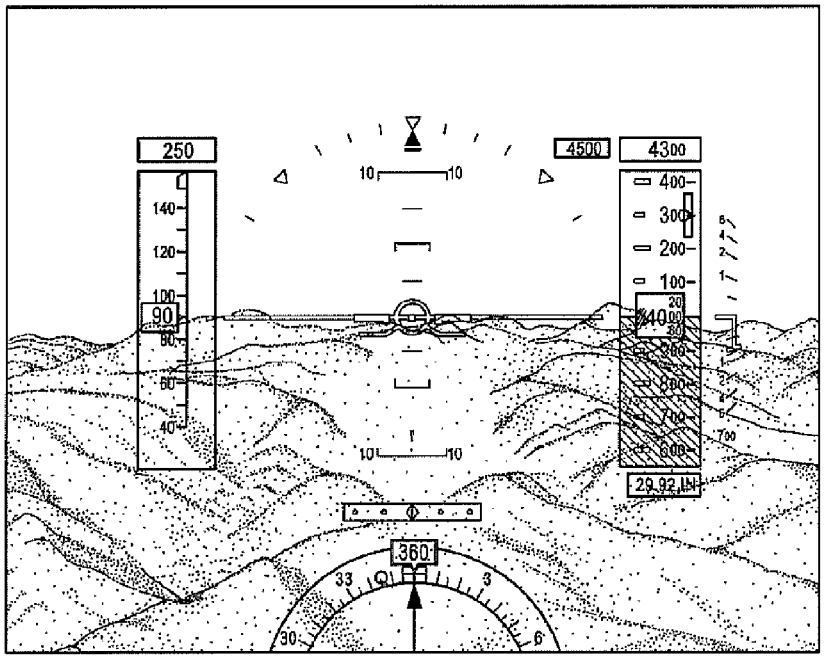

The drawings of FIGS. 2A and 2B provide exemplary depictions of a head-down display unit and a head-up display unit, respectively.

Figure 2C:
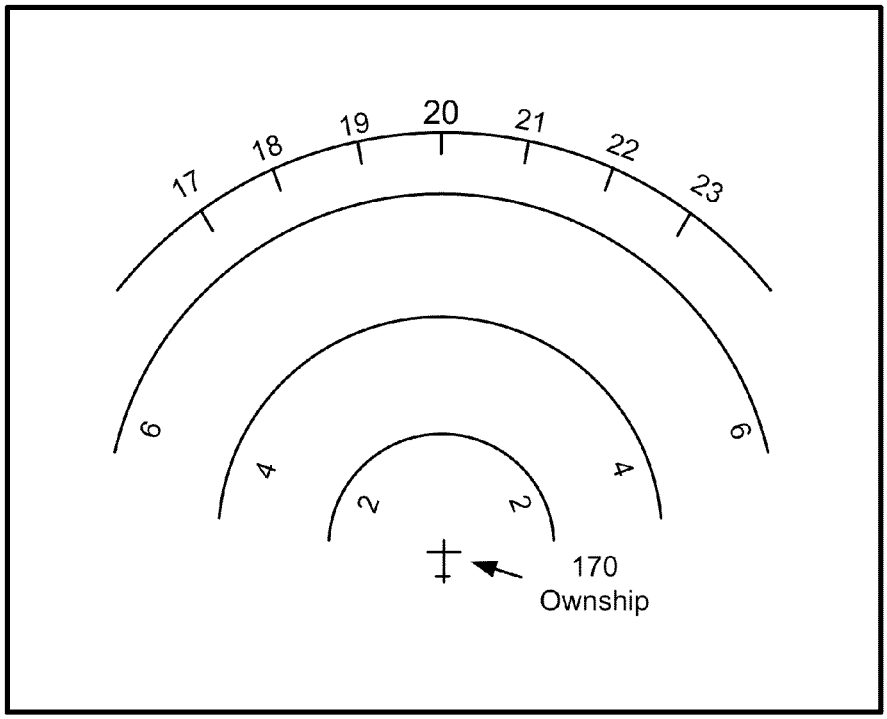
Figure 2D:
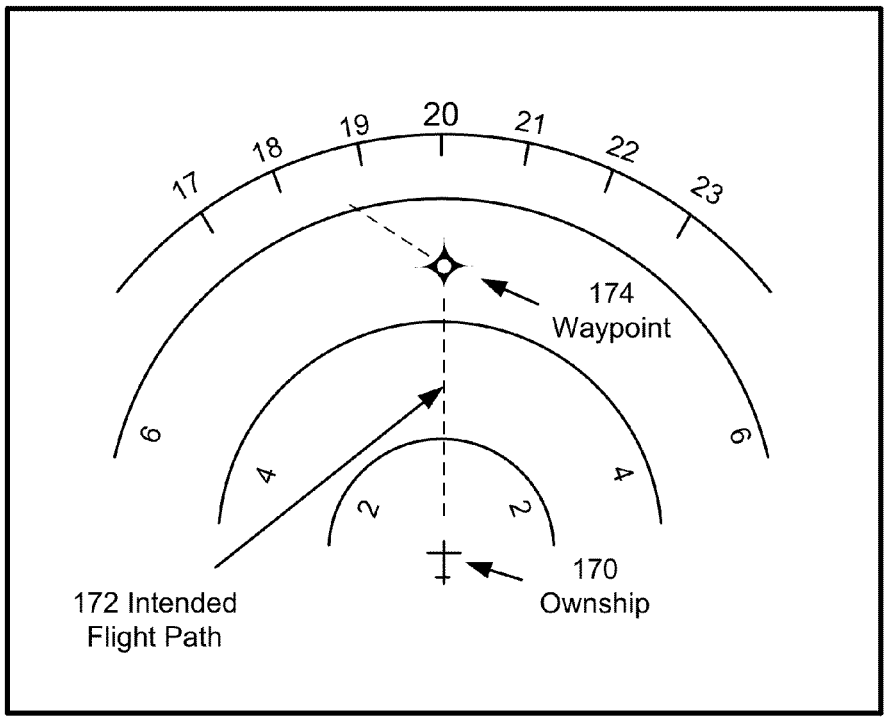

The drawings of FIGS. 2C and 2D provide exemplary depictions of strategic display units for presenting strategic information to the pilot or flight crew.

Figure 3A:
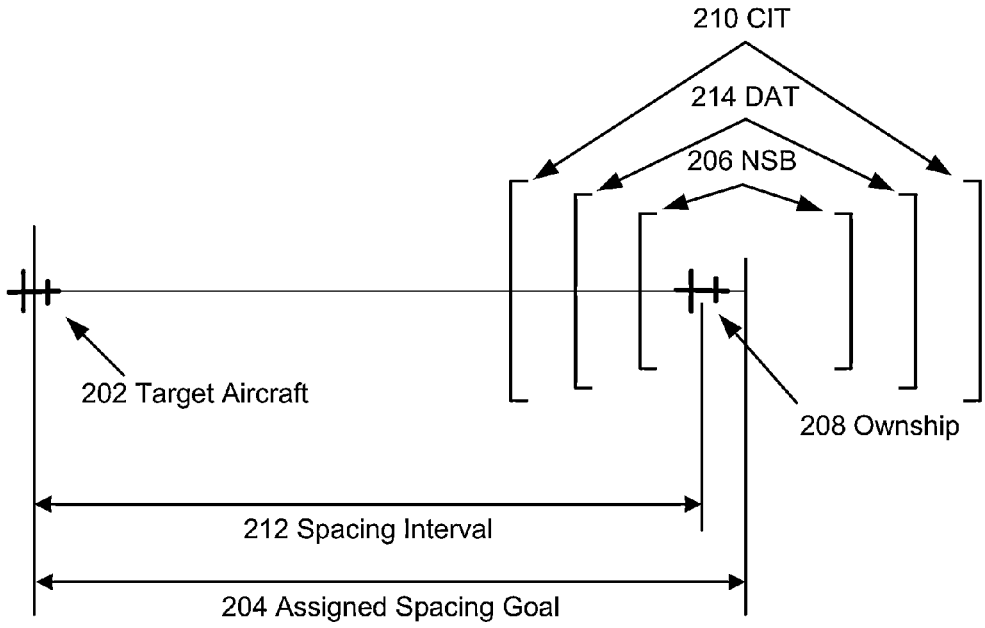
Figure 3B:
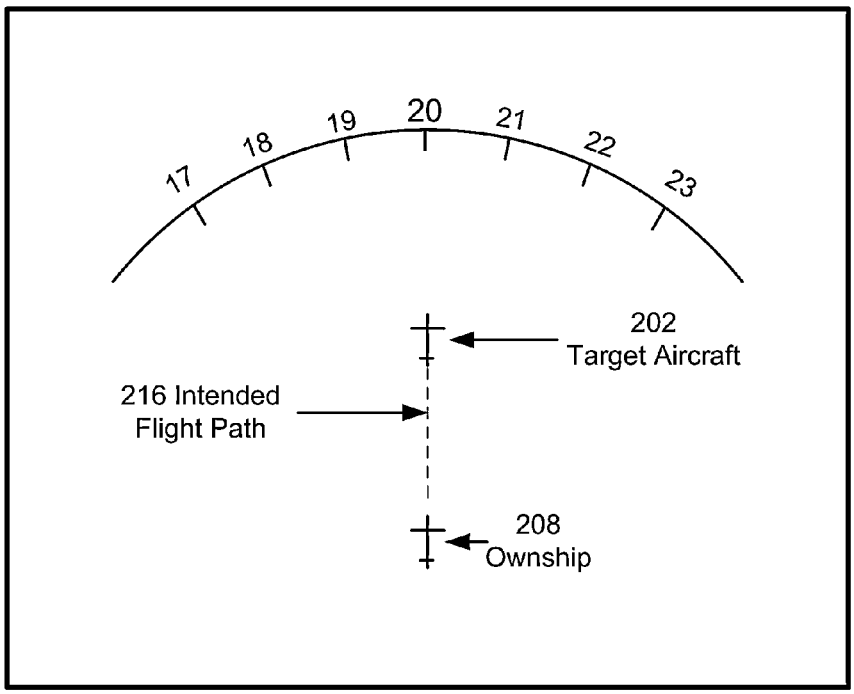

The drawings of FIGS. 3A and 3B depict components of an interval management ("IM") operation and a strategic display unit presenting IM operation information relative to ownship in a first example.

Figure 4A:
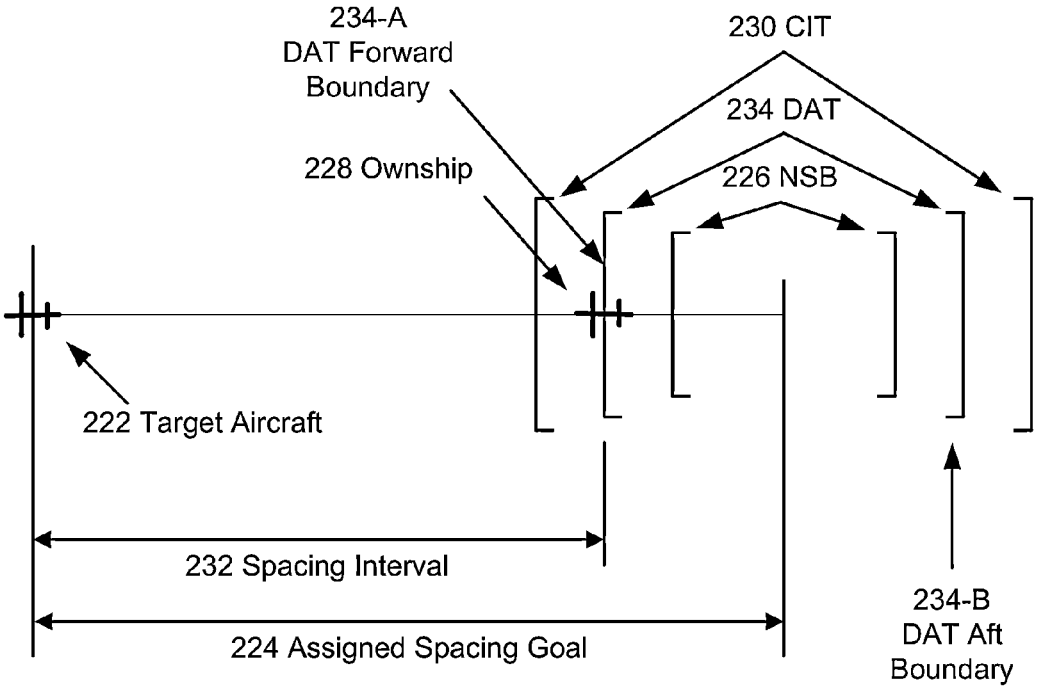
Figure 4B:
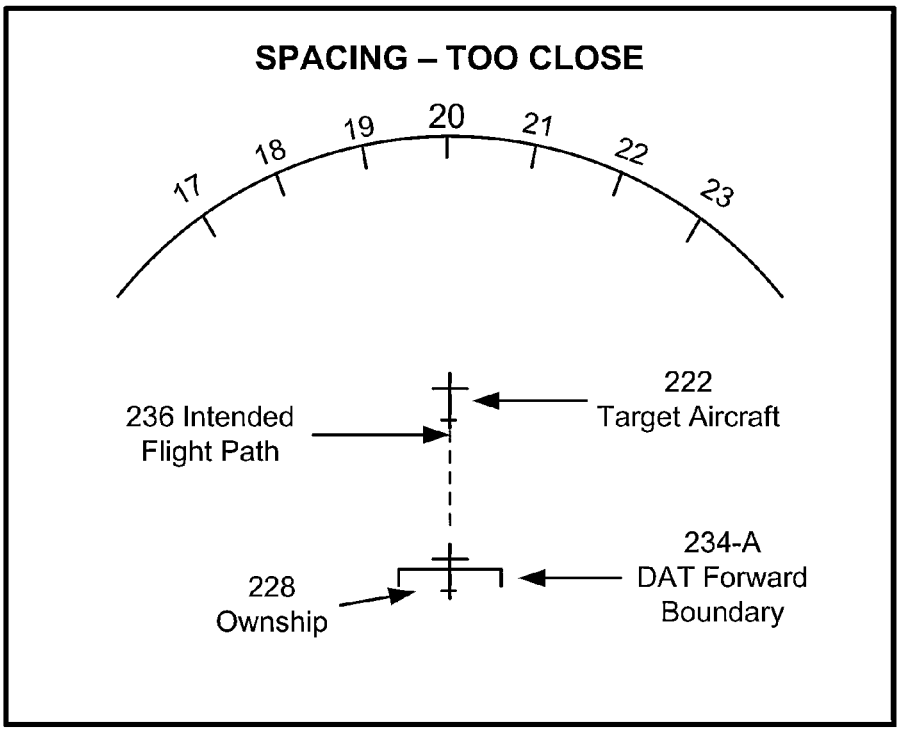

The drawings of FIGS. 4A and 4B depict components of an IM operation and a strategic display unit presenting IM operation information relative to ownship in a second example.

Figure 5A:
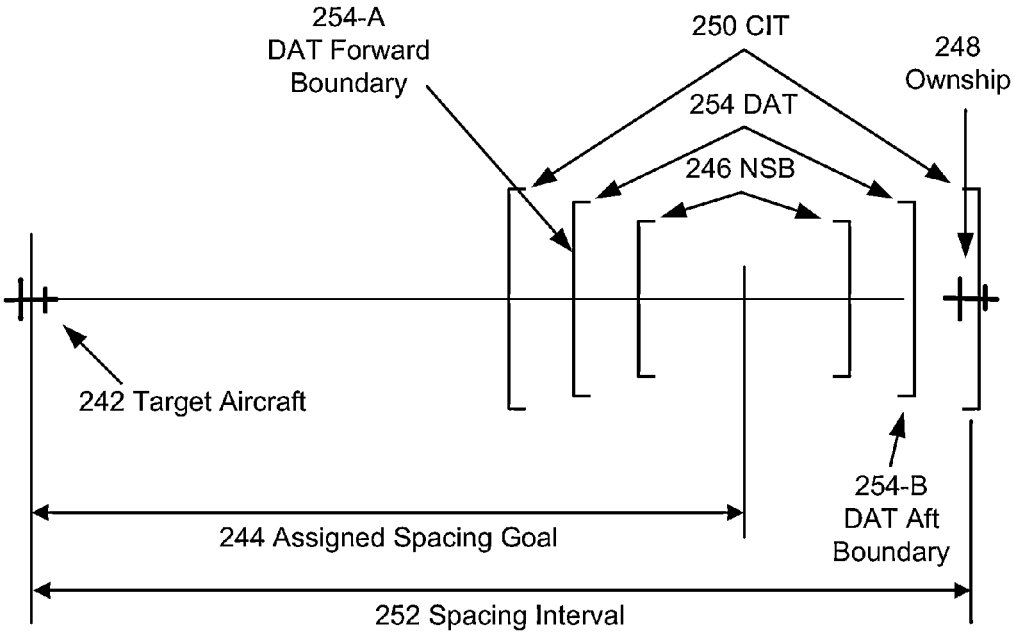
Figure 5B:
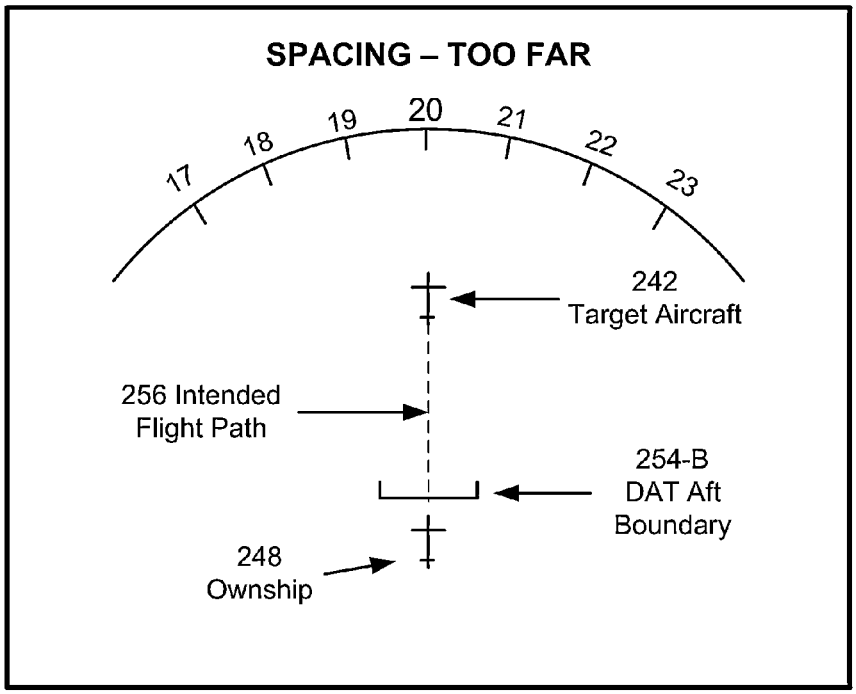

The drawings of FIGS. 5A and 5B depict components of an IM operation and a strategic display unit presenting IM operation information relative to ownship in a third example.

Figure 6A:
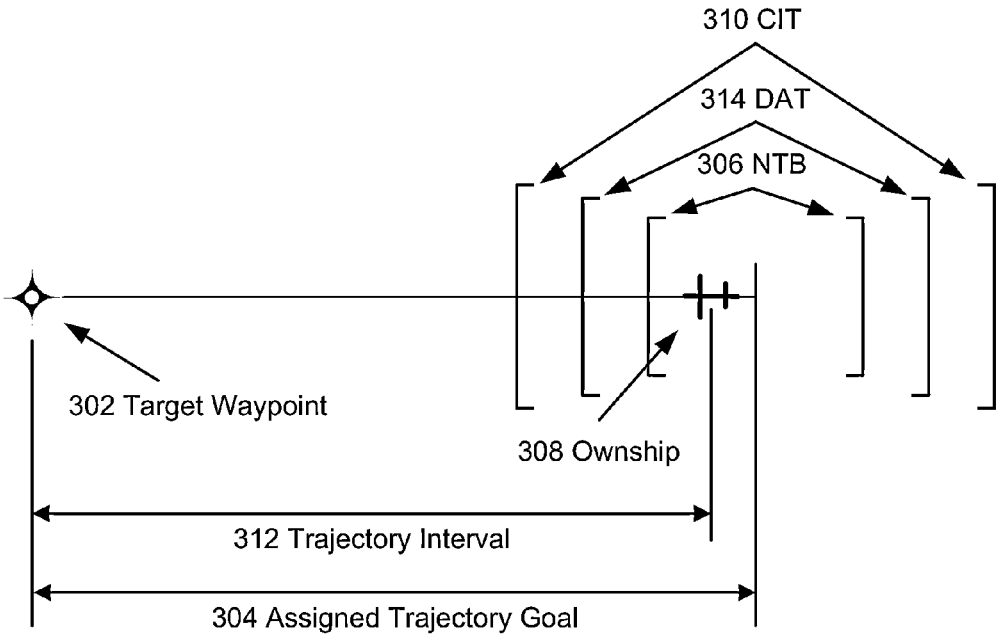
Figure 6B:
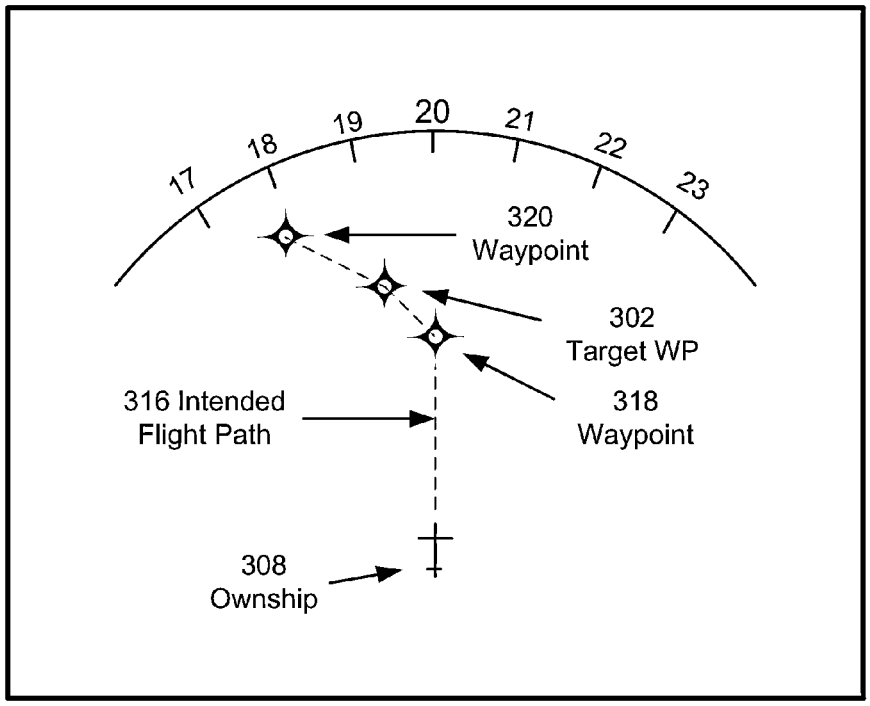

The drawings of FIGS. 6A and 6B depict components of a trajectory management ("TM") operation and a strategic display unit presenting TM operation information relative to ownship in a first example.

Figure 7A:
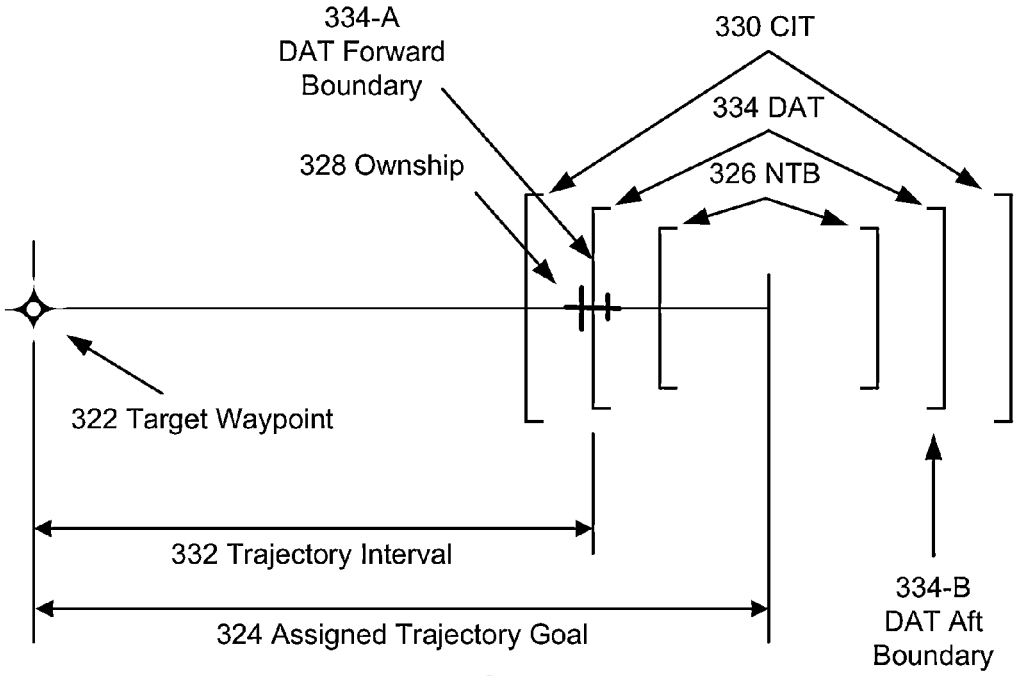
Figure 7B:
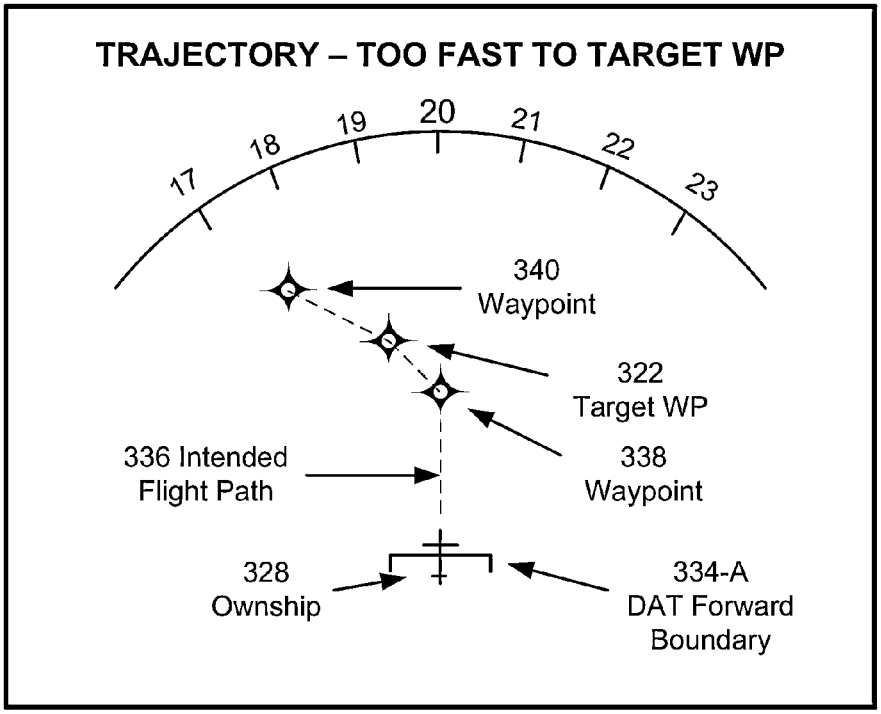

The drawings of FIGS. 7A and 7B depict components TM operation and a strategic display unit presenting TM operation information relative to ownship in a second example.

Figure 8A:
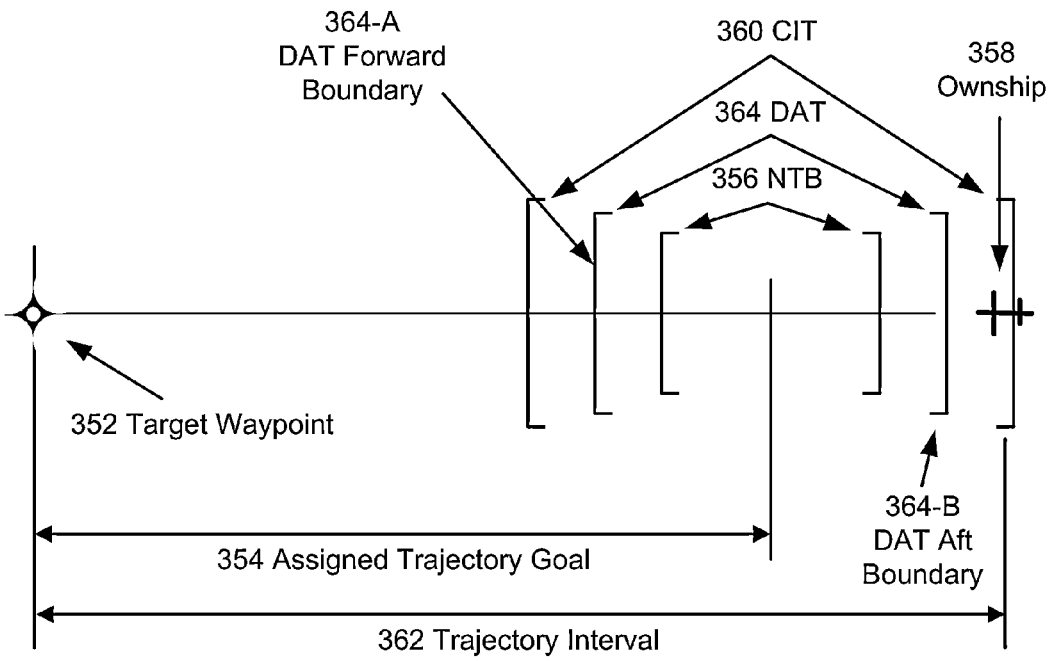
Figure 8B:
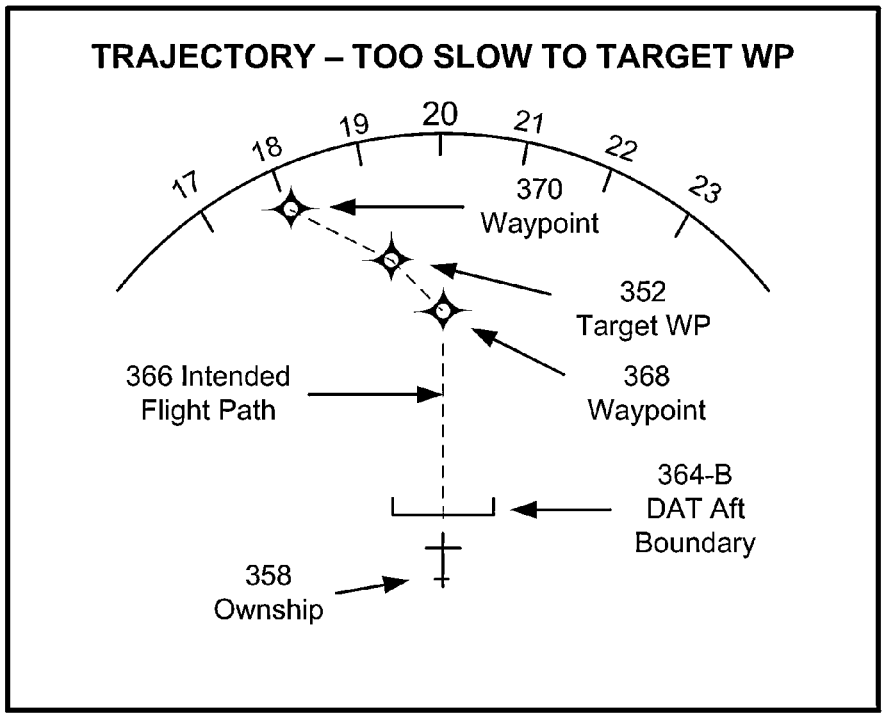

The drawings of FIGS. 8A and 8B depict components of an TM operation and a strategic display unit presenting TM operation information relative to ownship in a third example.

Figure 9:
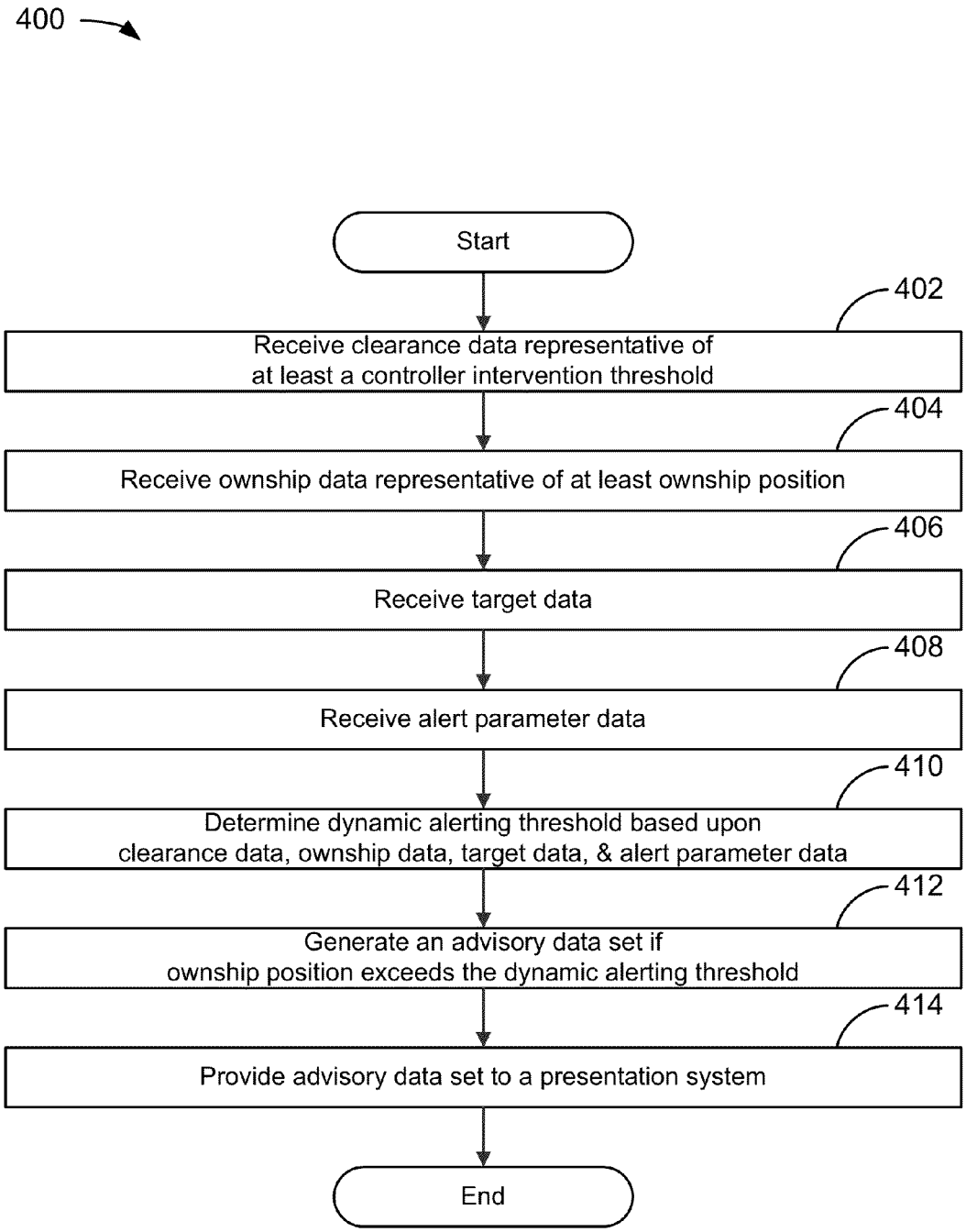

FIG. 9 depicts a flowchart of a method for presenting clearance-dependent advisory information in an aircraft.

DETAILED DESCRIPTION OF THE INVENTION

In the following description, several specific details are presented to provide a thorough understanding of embodiments of the invention. One skilled in the relevant art will recognize, however, that the invention can be practiced without one or more of the specific details, or in combination with other components, etc. In other instances, well-known implementations or operations are not shown or described in detail to avoid obscuring aspects of various embodiments of the invention.

Figure 1:
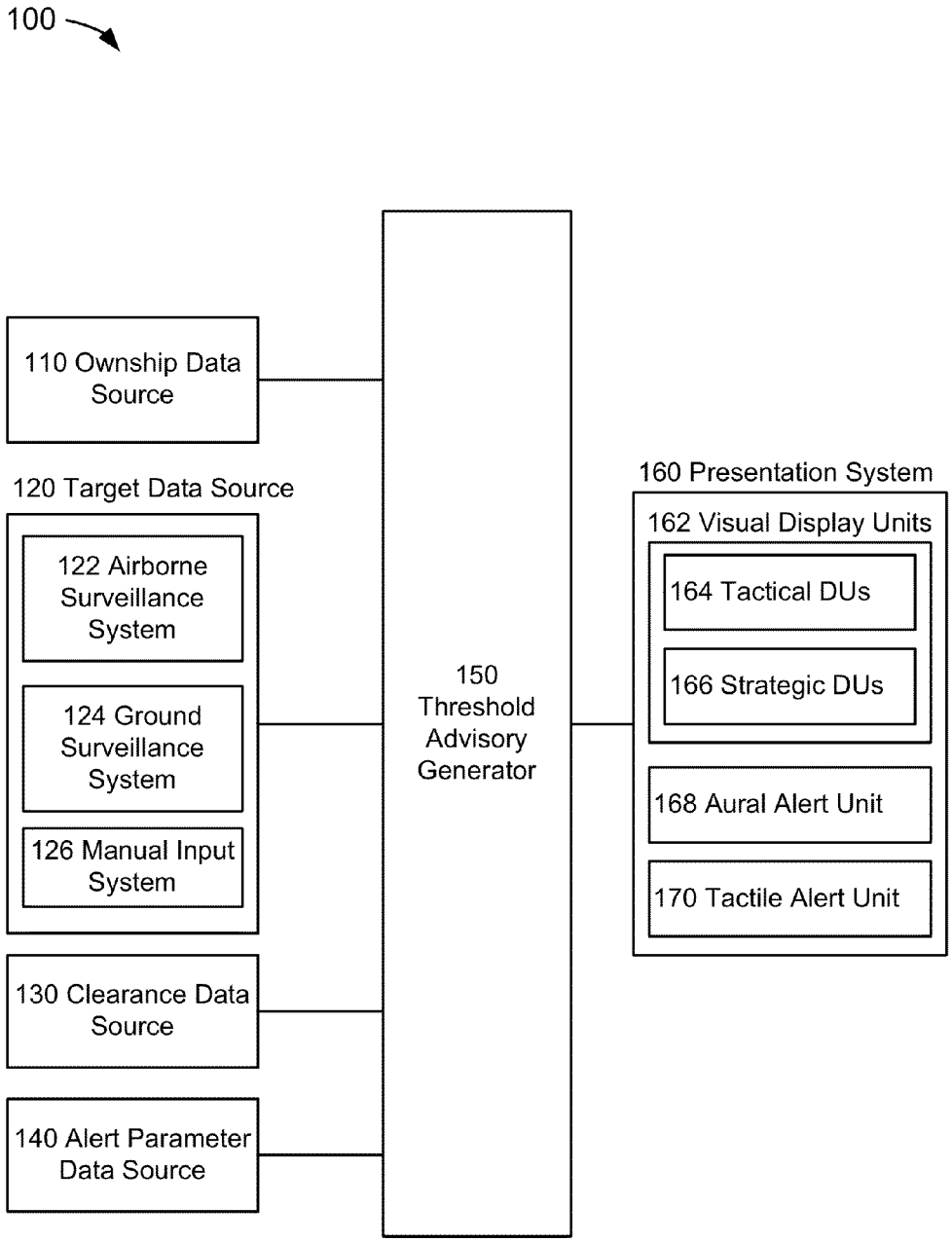
FIG. 1 depicts a block diagram of a clearance-dependent advisory information presentation system.

FIG. 1 depicts a block diagram of a clearance-dependent advisory system 100 suitable for implementation of the techniques described herein. The clearance-dependent advisory system 100 of an embodiment of FIG. 1 includes an ownship data source 110, a target data source 120, a clearance data source 130, an alert parameter data source 140, a threshold advisory ("TA") generator 150, and a presentation system 160.

In an embodiment of FIG. 1, the ownship data source 110 could be comprised of any source which provides data representative of ownship information, where such information could be comprised of, but not limited to, horizontal position, vertical position, pressure altitude, horizontal velocity, vertical velocity, horizontal position accuracy, vertical position accuracy, horizontal velocity accuracy, vertical velocity accuracy, and/or ownship intended flight path information. As embodied herein, the terms "ownship," "IM aircraft," and "TM aircraft" are synonymous. One ownship data source 110 for providing ownship information data could be a navigation system found in an aircraft. It should be noted that data, as embodied herein for any source or system in an aircraft including the navigation system, could be comprised of any analog or digital signal, either discrete or continuous, which could contain information. As embodied herein, data and signals are treated synonymously. Aircraft could mean any vehicle which is able to fly through the air or atmosphere including, but not limited to, lighter than air vehicles and heavier than air vehicles, wherein the latter may include fixed-wing and rotary-wing vehicles. The navigation system may include, but is not limited to, an air/data system, an attitude heading reference system, an inertial guidance system (or inertial reference system), a global navigation satellite system (or satellite navigation system), and/or a flight management computing ("FMC") system (which is comprised of, in part, a database), all of which are known to those skilled in the art. As embodied herein, one or more systems of the ownship data source 110 may provide ownship information data to the TA generator 150.

In an embodiment of FIG. 1, the target data source 120 could be comprised of any source which provides data representative of target information where the target could include, but not be limited to, a one or more target aircraft and/or one or more target waypoints. For a target aircraft, target information could be comprised of, but not limited to, target aircraft identification and target aircraft intended flight path information from the ground-provided data, horizontal position, vertical position, pressure altitude, horizontal velocity, vertical velocity, horizontal position accuracy, vertical position accuracy, horizontal velocity accuracy, vertical velocity accuracy, and/or aircraft identification. For a target waypoint, target information could be comprised of, but not limited to, three-dimensional position-related data comprised of latitude, longitude, and elevation (or altitude or height) and/or four-dimensional which includes time-related data as well as position-related data. The target data source 120 for target aircraft could be comprised of one or more systems such as, but not limited to, an airborne surveillance system 122, a ground surveillance system 124, and/or a manual input system 126. The target data source 120 for a target waypoint could be comprised of, for example, the FMC system of the ownship data source 110.

The airborne surveillance system 122 could be any system equipped in an aircraft that receives target information data that has been provided by other aircraft. As embodied herein, the airborne surveillance system 122 could include, but is not limited to, an aircraft datalink system, an automatic dependent surveillance-broadcast ("ADS-B") system, an on-board airborne radar system, an on-board optical aircraft sensor system, and/or a traffic collision avoidance system ("TCAS").

The ground surveillance system 124 could be comprised of any system equipped in an aircraft that receives target information data provided from external sources other than airborne surveillance systems 122. The ground surveillance system 124 could include a traffic information service-broadcast ("TIS-B") system and/or an automatic dependent surveillance-rebroadcast ("ADS-R") system, each of which are known to those skilled in the art. The ground surveillance system 124 could include any system equipped in an aircraft for facilitating direct controller-pilot communications from an air navigation service provider ("ANSP") such as an air traffic controller. Such facilitating system could include, but not limited to, datalink and voice communications. If target information is provided through voice communications, the manual input device 126 could be used thereafter by the pilot or flight crew to provide the target information to the TA generator 150.

The manual input system 126 could comprise any source that provides or enables a pilot to enter target information manually instead of automatically. The manual input system 126 may include, but is not limited to, a tactile device (e.g., keyboard, control display unit, cursor control device, touch screen device, etc.) and/or speech recognition systems. As embodied herein, the touch screen device could include a visual display unit 162 as discussed in detail below if it is able to receive pilot input. As embodied herein, one or more systems of the target data source 120 may provide target information data to the TA generator 150.

In an embodiment of FIG. 1, the clearance data source 130 could be comprised of any source which provides data representative of clearance information where the clearance could be comprised of, but not limited to, a spacing clearance used in an interval management ("IM") operation and/or a trajectory clearance used in a trajectory management ("TM") operation. The spacing clearance could include, but not be limited to, a target aircraft, where such information could be comprised of, but not limited to, target aircraft identification, assigned spacing goal, spacing clearance type or maneuver, achieve-by point, intercept point, planned termination point, IM tolerance, IM aircraft intended flight path information, and/or target aircraft intended flight information. As embodied herein, spacing clearance information may include a controller intervention threshold ("CIT") assigned to the spacing clearance and/or an IM operation designator from which the CIT may be determined. Although an assigned CIT may be included, the spacing clearance may be associated with an IM operation performed in the absence of a controller.

The trajectory clearance could include, but not be limited to, a target waypoint, where such information could include time-related data as well as position-related data and/or waypoint identifier information of the target waypoint, an assigned trajectory goal, a TM tolerance, trajectory clearance type, and/or TM aircraft intended flight path information. As embodied herein, trajectory clearance information may include a CIT assigned to the trajectory clearance and/or a TM operation designator from which the CIT may be determined. Although an assigned CIT may be included, the trajectory clearance may be associated with a TM operation performed in the absence of a controller.

Generally, a clearance is received from the ANSP. As such, the clearance data source 130 could be any system equipped in an aircraft for facilitating direct controller-pilot communications from an ANSP such as an air traffic controller. Such facilitating system could include, but not limited to, datalink and voice communications. If the clearance is provided through voice communications, the manual input device 126 could be used thereafter. As embodied herein, the clearance data source 130 and the target data source 120 may be comprised of the same source. Additionally, one or more systems of the clearance data source 130 may provide clearance information to the TA generator 150.

In an embodiment of FIG. 1, the alert parameter data source 140 could be comprised of any source which provides data representative of one or more alert parameters that may be applied in an alert generating function to determine a dynamic alerting threshold ("DAT") and, if necessary, generate an alert as discussed in detail below. The application of the alert parameter(s) may determine a DAT that represents real-time predictable and achievable aircraft performance that may affect the maneuverability and/or responsiveness of the aircraft when operating within IM and TM operations. The advantages and benefits of the embodiments disclosed herein exploit the ability of the TA generator 150 to receive a plurality of alert parameters, apply them to the alert generating function defined and contained in an algorithm, determine the DAT unique to actual conditions of flight operations as measured by the values of the alert parameters, and generate an alert if the threshold has been exceeded.

To provide a simple example of how alert parameters may be used in the embodiments herein, suppose the alert generating function includes meteorological or environmental parameters; those skilled in the art are aware that meteorological or environmental conditions affect aircraft performance and/or maneuverability. Meteorological or environmental parameters could include, but are not limited to, data representative of air density and winds aloft, where air density may determined by such parameters as altitude, temperature, barometric pressure, and dew point, and winds aloft may determined by such parameters as wind direction and wind speed. Here, data representative of these parameters may be provided as alert parameters to the TA generator 150 for subsequent application of the alert generating function. The alert generating function could increase the DAT threshold for those meteorological conditions conducive to aircraft operating under visual flight rules and/or maximum aircraft performance; conversely, the alert generating function could decrease the DAT threshold for those meteorological conditions conducive to aircraft operating under instrument flight rules and/or degraded aircraft performance. After the application of the alert parameters, the alert generating function may determine the DAT; if this threshold is exceeded, the TA generator 150 may generate data representative of an alert.

It should be noted that the alert parameter data source 140 could be comprised of the ownship data source 110, the target data source 120, and/or the clearance data source 130, where data from each of these sources could be applied to the alert generating function as alert parameters. As such, the alert parameter data source 140 could be a source from which data is generated internal to the aircraft or externally and received through an onboard communication interface such as a datalink. In the previous example, data representative of altitude and barometric pressure could have been provided by the ownship data source 110 of which an aircraft navigation system has been included. Also, one or more parameters could be included in the computation of another parameter. In the previous example, winds aloft could have been considered in a computation of speed, and barometric pressure could have been considered in a computation of altitude. In such instances, the TA generator 150 may be programmed to accept only one of the parameters as an alert parameter.

In the following paragraphs, other examples of alert parameters are provided to illustrate the ability with which a manufacturer or end user may define an alert generating function as embodied herein. These illustrations are intended to provide exemplary alert parameters that may be used in the CIT advisory information system 100, and are not intended to provide a limitation to the embodiments discussed herein in any way, shape, or form.

In one example, the alert generating function could include weight and balance parameters which affect the performance of an aircraft; if so, alert parameters could include data representative of aircraft empty weight, center of gravity ("CG"), weight of fuel, and/or weight of cargo. In another example, the alert generating function could include aircraft configuration and system parameters which could indicate an aircraft's capability of maximum performance; if so, alert parameters could include data representative of the configuration(s) and/or operability of the aircraft flaps/slats, speed brake position and/or the landing gear. In another example, the alert generating function could include engine performance parameter(s) which could indicate an aircraft's capability of maximum performance; if so, alert parameters could include data representative of engine performance or status or available thrust. In another example, the alert generating function could include aircraft traffic information other than and/or in addition to target aircraft information which could cause for an unplanned change to the spacing clearance; if so, alert parameters could include data representative of horizontal position, vertical position, pressure altitude, horizontal velocity, vertical velocity, horizontal position accuracy, vertical position accuracy, horizontal velocity accuracy, vertical velocity accuracy, and/or aircraft identification of the other aircraft.

In another example, the alert generating function could include braking condition parameters from which to judge the time target aircraft could occupy the runway upon landing; if so, alert parameters could include data representative of reported weather data and/or runway information stored from an aircraft database. In another example, the alert generating function could include parameters related to the quality of data provided by one or more of the data sources; if so, alert parameters could include data representative of accuracy, resolution, integrity, uncertainty, and/or validity. In another example, the alert generating function could include wake turbulence parameters; if so, alert parameters could include data representative of aircraft target aircraft category and type, ownship category and type, and/or separation requirements for avoiding wake turbulence that may be retrieved from an aircraft database. In another example, the alert generating function could include human factors; if so, alert parameters could include data representative of a configurable pilot response time.

In an embodiment of FIG. 1, the TA generator 150 may be any electronic data processing unit which executes software or source code stored, permanently or temporarily, in a digital memory storage device as discussed above. The TA generator 150 may be driven by the execution of software or source code containing algorithms developed for the specific functions embodied herein. Common examples of electronic data processing units are microprocessors, Digital Signal Processors, Programmable Logic Devices, Programmable Gate Arrays, and signal generators; however, for the embodiments herein, the term generator is not limited to such processing units and its meaning is not intended to be construed narrowly. For instance, a processor could also consist of more than one electronic data processing units. As embodied herein, the TA generator 150 could be a processor(s) used by or in conjunction with any other system of the aircraft.

The TA generator 150 may be programmed or configured to receive as input data representative of information provided from the ownship data source 110, the target data source 120, and the clearance data source 130. Also, the TA generator 150 may be programmed to provide output data to the presentation system 160. As embodied herein, the terms "programmed" and "configured" are synonymous with respect to the execution of software or source code developed for the specific functions and methods embodied herein. The TA generator 150 may be programmed to execute the methods embodied herein and discussed in detail below. The TA generator 150 may be operatively coupled to the ownship data source 110, the target data source 120, the clearance data source 130, and the presentation system 160. To be operatively coupled, it is not necessary that a direct connection be made; instead, such receipt of input data and the providing of output data could be provided through a data bus or through a wireless network.

The presentation system 160 could be comprised of any unit of which visual, aural, and/or tactile indications may be presented to the pilot including, but not limited to, visual display units 162, an aural alerting unit 168, and/or a tactile alerting unit 170. Visual display units 162 could be comprised of any unit having a display surface on which information may be presented to the pilot. The visual display unit 162 could be part of an Electronic Flight Information System ("EFIS") and could be comprised of, but is not limited to, a Primary Flight Display ("PFD"), Navigation Display ("ND"), Head-Up Display ("HUD"), Head-Down Display ("HDD"), Multi-Purpose Control Display Unit, Engine Indicating and Crew Alerting System, Electronic Centralized Aircraft Monitor, Multi-Function Display, Side Displays, Electronic Flight Bags, and/or Data Link Control Display Unit. As embodied herein, visual display units 162 may include a vision system (not shown) which generates an image data set which represents the image displayed on a display unit. Vision systems include, but are not limited to, a synthetic vision system ("SVS"), an enhanced vision system ("EVS"), a combined SVS-EVS, or combination thereof.

Visual display units 162 could be considered as tactical display unit(s) 164 and/or a strategic display unit(s) 166. The tactical display unit 164 could be any unit which presents tactical information to the crew relative to the instant or immediate control of the aircraft, whether the aircraft is in flight or on the ground. The tactical display unit 164 could be an HDD unit and/or a HUD unit. The HDD unit is typically a unit mounted to an aircraft's flight instrument panel located in front of a pilot and below the windshield. The HUD unit is mounted in front of the pilot at windshield level. The HUD unit is advantageous because the display is transparent allowing the pilot to keep his or her eyes "outside the cockpit" while the display unit provides tactical flight information to the pilot.

The tactical display unit 164 could display the same information found on a PFD, such as "basic T" information (i.e., airspeed, attitude, altitude, and heading). Although it may provide the same information as that of a PFD, a tactical display unit 164 may also display a plurality of indications or information including, but not limited to, selected magnetic heading, actual magnetic track, selected airspeeds, selected altitudes, altitude barometric correction setting, vertical speed displays, flight path angle and drift angles, flight director commands, limiting and operational speeds, mach number, radio altitude and decision height, final approach trajectory deviations, and marker indications. The tactical display unit 164 is designed to provide flexible configurations which may be tailored to the desired configuration specified by a buyer or user of the aircraft.

The drawings of FIG. 2 provide exemplary depictions of tactical display units 164. FIG. 2A provides an exemplary depiction of an HDD unit for presenting tactical information to the pilot or flight crew against the background of a three-dimensional image of terrain and sky, and FIG. 2B provides an exemplary depiction of a HUD unit for presenting tactical information to the pilot or flight crew against the background of a three-dimensional image of terrain. The HDD unit and/or the HUD unit could be employed as a display unit in an SVS, EVS, and/or a combined SVS-EVS. It should be noted that the depiction of symbology representative of tactical information on the HDD unit and the HUD unit has been made minimal for the sake of presentation and is not indicative of the plurality of indications or information with which it may be configured. Because the indications or information shown in the drawings of FIGS. 2A and 2B are well-known to those skilled in the art, a discussion of the specific tactical information is not provided herein.

Returning to FIG. 1, the strategic display unit 166 could be any unit which presents strategic information to the crew relative to the intended future state(s) of the aircraft (e.g., intended location in space at specified times) along with information providing contextual information to the crew (e.g., terrain, navigation aids, geopolitical boundaries, airspace boundaries, etc.) about such state(s). One example of such display unit is an ND.

The drawings of FIGS. 2C and 2D provide exemplary depictions of strategic display units 166 for presenting strategic information to the pilot or flight crew. FIG. 2C provides an exemplary depiction of how range symbology may be presented on the display surface of the strategic display unit 166. If terrain and/or weather information is presented on the strategic display unit 166, the presence of the range symbology makes it possible for the pilot to estimate the distance from the aircraft he or she is flying, i.e., ownship 170, to terrain and/or weather that might concern the pilot. FIG. 2D provides an exemplary depiction of how an intended flight plan 172 may be presented on the display surface of the strategic display unit 166; with the presence of the range symbology, the pilot may estimate that there is a left turn along the intended flight path 172 at a waypoint 174 approximately 5 nautical miles in front of ownship 170. It should be noted that the depiction of symbology representative strategic information on the strategic display unit 166 has been made minimal for the sake of presentation and is not indicative of the plurality of indications or information with which it may be configured. Because the indications or information shown in the drawings of FIGS. 2C and 2D are well-known to those skilled in the art, a discussion of the specific strategic information is not provided herein.

Returning to FIG. 1, the visual display unit 162 could be capable of presenting advisory information which may be information that is projected or displayed on a cockpit display unit to present a condition, situation, or event to the pilot including other display units in addition to the tactical display unit 164 and the strategic display unit 166. Advisory information may include alerts and/or non-alert(s). Alerts may be based on level of threat or conditions requiring immediate crew awareness or attention. Caution alerts may be alerts requiring immediate crew awareness in which subsequent corrective action will normally be necessary. Warning alerts may be alerts requiring immediate crew action. As embodied herein, both caution and warning alerts may be presented in combination with or simultaneous to aural alerts and/or tactile alerts. Non-alerts may be any other information not requiring immediate crew attention or awareness. Alerts may be presented visually by depicting one or more colors and may be presented on a display unit indicating one or more levels of threat. For the purpose of illustration and not limitation, amber or yellow may indicate a caution alert, red may indicate a warning alert, and green or cyan may indicate a non-alert.

In one embodiment, visual alerts could be presented in a textual form including colored text messages such as an amber or yellow when the conditions for a caution alert have been met or a red when the conditions for a warning alert have been met. In another embodiment, visual alerts could be presented in non-textual forms including, but not limited to, a graphical object highlighting a boundary of a DAT as discussed in detail below. In another embodiment, non-textual and textual forms could be displayed in color to indicate the level of threat, e.g., amber or yellow may indicate a caution alert and red may indicate a warning alert. In another embodiment, non-textual and textual forms could remain steady or flash intermittently; the occurrence of such flashing could depend on the distance and/or time between the boundary of the DAT and ownship, and the rate of flashing could represent a specific range to the other traffic. Examples using visual alerts are discussed in detail below.

Returning to FIG. 1, the aural alerting unit 168 may be any unit capable of producing aural alerts. Aural alerts may be discrete sounds, tones, and/or verbal statements used to annunciate a condition, situation, or event. For example, in an embodiment associated with a spacing clearance of an IM operation, an aural alert could call out "CAUTION—SPACING TOO CLOSE" or "CAUTION—SPACING TOO FAR" when the conditions for a caution alert have been met or "WARNING—SPACING TOO CLOSE" or "WARNING—SPACING TOO FAR" when the conditions for a warning alert have been met, and either or both could be accompanied with tonal indicators. As embodied herein, both caution and warning aural alerts could be presented in combination with or simultaneous to visual alerts and/or tactile alerts.

In an embodiment of FIG. 1, the tactile alerting unit 170 may be any unit capable of producing tactile alerts. Tactile alerts may be any tactile stimulus to present a condition, situation, or event to the pilot such as, but not limited to, a warning alert and/or a caution alert. Moreover, tactile alerts could be presented in combination with or simultaneous to visual alerts and/or tactile alerts. As embodied herein, one or more units of the presentation system 160 may receive DAT alert data provided by the TA generator 150.

The advantages and benefits of the embodiments discussed herein of a clearance-dependent advisory information system 100 may be illustrated with the use of the DAT within IM operations. The drawings of FIG. 3 disclose some components of an IM operation and a depiction of them on a strategic display unit comprised of an HDD unit. Referring to FIG. 3A, some of the components of an IM operation could include the target aircraft 202, an assigned spacing goal 204, and an IM tolerance indicated as the time and/or distance between nominal spacing bounds ("NSB") 206.

The assigned spacing goal 204 may be expressed as a unit of time and/or distance. The assigned spacing goal 204 may include, but is not limited to, specific value (or values) of time and/or distance (e.g., an assigned spacing goal 204 of 90 seconds), a closed range of values (e.g., an assigned spacing goal 204 of a spacing interval between 90 seconds and 120 seconds from the target aircraft), an open range of values (e.g., an assigned spacing goal 204 of a spacing interval no closer than 90 seconds), or is may include both time and distance (e.g., an assigned spacing goal 204 of a spacing interval of 90 seconds in time and no closer than 4 nautical miles from the target aircraft), or combinations thereof.

Known to those skilled in the art, NSB 206 could relate to operational goals that are set for a specific IM operation. As discussed above, the target aircraft 202, an assigned spacing goal 204, and an IM tolerance could be included in a spacing clearance assigned to the IM aircraft or ownship 208 as provided by the ANSP.

As disclosed herein, other components could be included in a spacing clearance such as the CIT 210, a component that could be established for an IM operation by an aviation governing authority and/or a standards setting organization for the aviation industry. The CIT 210 may be a threshold which, if met or exceeded by ownship 208, may cause the controller to intervene in the IM operation if the spacing interval 212 (the time and/or distance between the target aircraft 202 and ownship 208) has deviated too far from the assigned spacing goal 204 and/or there is a loss of controller trust that ownship 208 is able to conform or comply with the spacing clearance. The CIT 210 may be defined as a percentage (e.g., 33%) of the assigned spacing goal 204, a maximum deviation from the assigned spacing goal 204, and/or some other algorithm(s) employed in a ground-based tool(s).

An alternative and/or additional embodiment, an IM operation designator could be component that could be included in a spacing clearance. Such IM operation designator could be associated with one of a plurality pre-defined IM operation scenarios defined in an algorithm(s) that is employed in a ground-based tool(s) used by the ANSP in finding and/or establishing one or more components assigned to IM aircraft in a spacing clearance. Because of the association between the IM operation designator and one or more of the pre-defined IM operation scenarios, the TA generator 150 could be configured with the algorithm(s) employed in a ground-based tool(s) to determine the CIT 210 applied by the ANSP.

As disclosed herein, a DAT 214 may be established for the purpose of preventing an intervening action by the controller if ownship 208 meets or exceeds the CIT 210. The DAT 214 may be established using a configurable alert generating function by applying spacing clearance information, ownship information, target aircraft information, and one or more alert parameters as variables to the alert generating function. By establishing the DAT 214, an alert may be presented to the pilot advising him or her that, if corrective spacing action is not taken, he or she may anticipate and/or expect the controller to take an interventional action. It should be noted that, although the DAT 214 is shown as less than the CIT 210 but greater than the NSB 206, it could be less than the NSB 206 if the alert generating function makes such determination after one or more alert parameters have been applied.

The position of ownship 208 with respect to the positions of target aircraft 202 and the DAT 214 as illustrated in FIG. 3A may be presented on a visual display unit. Referring to FIG. 3B, the relative positions of the target aircraft 202 and ownship 208 are depicted on the visual display unit along with the intended flight path 216 of ownship 208, where such depictions could be generated from data representative of the positions of the target aircraft 202 and ownship 208 as well as information corresponding to the intended flight path 216. Because the position of ownship 208 falls in between the boundaries of the DAT 214, no CIT advisory information comprised of a first-level or second-level alert is presented on a unit of the presentation system 160.

It should be noted that, although the forward and aft boundaries of the NSB, the CIT, and the DAT are shown as being centered about the assigned spacing goal, it is not necessary that the distances to each of these boundaries are equal, plus or minus the same amount from the assigned spacing goal. As embodied herein, the distance from the assigned spacing goal of one or more forward boundaries may be greater or less than the distance from the assigned spacing goal of one or more aft boundaries. Additionally, one or more of the forward boundaries or one or more of the aft boundaries may be zero.

The drawings of FIG. 4 provide an example of a target aircraft 222, an assigned spacing goal 224, NSB 226, ownship 228, a CIT 230, a spacing interval 232, a DAT 234, a forward boundary of the DAT 234-A, an aft boundary of the DAT 234-B, and an intended flight path 236. In this example, ownship 228 is depicted as intersecting the DAT 234, i.e., the position of ownship 228 intersects the position of the forward boundary of the DAT 234-A. Because the position of ownship 228 intersects the forward boundary of the DAT 234-A, CIT visual advisory information comprised of textual and/or non-textual information corresponding to a first-level alert may be generated.

As shown in FIG. 4B, textual information comprised of the text message "SPACING—TOO CLOSE" and non-textual information comprised of a graphical object of a bracket coinciding with the forward boundary of the DAT 234-A are presented on a visual display unit of the presentation system 160. Also, the visual information could be presented in amber or yellow indicative of a caution alert. As embodied herein, visual advisory information is not limited to the text message and/or the graphical object shown in FIG. 4B but may be any text message and/or graphical object which conveys to the pilot information that ownship 228 has met or exceeds the DAT 234. Additionally, visual advisory information is not limited to being presented on a strategic display unit as shown in FIG. 4B; for example, visual advisory information could be presented on the tactical display unit(s) 164 shown in the drawings of FIGS. 2A and 2B. In an additional and/or alternative embodiment, CIT aural advisory information such as "CAUTION—SPACING TOO CLOSE" may be presented through an aural alerting unit and/or tactile advisory information may be presented through a tactile alerting. It should be noted that applicable advisory information (i.e., too far) could be presented if the position of ownship 228 had intersected the position of the aft boundary of the DAT 234-B.

The drawings of FIG. 5 provide an example of a target aircraft 242, an assigned spacing goal 244, NSB 246, ownship 248, a CIT 250, a spacing interval 252, a DAT 254, a forward boundary of the DAT 254-A, an aft boundary of the DAT 254-B, and an intended flight path 256. In this example, ownship 248 is depicted as intersecting the CIT 250, i.e., the position of ownship 248 intersects the position of the aft boundary of the CIT 250. Because the position of ownship 248 has exceeded the aft boundary the DAT 254-B and now intersects the aft boundary of the CIT 250, CIT visual advisory information comprised of textual and/or non-textual information corresponding to a second-level alert may be generated.

As shown in FIG. 5B, textual information comprised of the text message "SPACING—TOO FAR" and non-textual information comprised of a graphical object of a bracket coinciding with the aft boundary of the DAT 258 are presented on a visual display unit of the presentation system 160. To distinguish the presentation of the second-level alert with the presentation of the first-level alert, the visual information could be presented in red indicative of a warning alert. In an additional and/or alternative embodiment, CIT aural advisory information such as "WARNING—SPACING TOO FAR" may be presented through an aural alerting unit and/or tactile advisory information may be presented through a tactile alerting. It should be noted that similar but applicable advisory information (i.e., too close) could be presented if the position of ownship 248 had intersected the position of the forward boundary of the CIT 250.

Although the above illustrations provided in the drawings of FIGS. 3 through 5 have been drawn for IM operations, the use of a DAT is not limited to clearances received for IM operations. The drawings of FIG. 6 through 8 disclose some components of a trajectory management ("TM") operation and depictions of them on a strategic display unit comprised of an HDD unit. Referring to FIG. 6A, some of the components of a TM operation could include a target waypoint 302, an assigned trajectory goal 304, and a TM tolerance indicated as a range of time and/or distances between nominal trajectory bounds ("NTB") 306. The assigned trajectory goal 304 may also be expressed as a time in which ownship 308 is expected to reach the target waypoint 302 or may also be expressed as a distance that ownship 308 is expected to be within of the target waypoint 302 at a specified time or combinations thereof, and the NTB 306 could be a range of times and/or distances related to operational goals that are set by a ANSP for a specific TM operation. As discussed above, the target waypoint 302, an assigned trajectory goal 304, and/or a TM tolerance could be included in a TM clearance assigned to ownship 308 as provided by the ANSP.

As disclosed herein, other components could be included in a TM clearance such as the CIT 310, a component that could be established for a TM operation by an aviation governing authority and/or a standards setting organization for the aviation industry. The CIT 310 may be a threshold which, if met or exceeded by ownship 308, may cause the controller to intervene in the TM operation if the trajectory interval 312 (the estimated time at which the target waypoint 302 will be reached by ownship 308) has deviated too far from the assigned trajectory goal 304 and/or there is a loss of controller trust that ownship 308 is able to conform or comply with the TM clearance. The CIT 310 may be defined by a maximum deviation from the assigned trajectory goal 304 and/or some other algorithm(s) employed in a ground-based tool(s).

An alternative and/or additional embodiment, a TM operation designator could be component that could be included in a TM clearance. Such TM operation designator could be associated with one of a plurality pre-defined TM operation scenarios defined in an algorithm(s) that is employed in a ground-based tool(s) used by the ANSP in finding and/or establishing one or more components assigned to a TM aircraft in a TM clearance. Because of the association between the TM operation designator and one or more of the pre-defined TM operation scenarios, the TA generator 150 could be configured with the algorithm(s) employed in a ground-based tool(s) to determine the CIT 310 applied by the ANSP.

As disclosed herein, a DAT 314 may be established for the purpose of preventing an intervening action by the controller if ownship 308 meets or exceeds the CIT 310. The DAT 314 may be established using a configurable alert generating function by applying TM clearance information, ownship information, target waypoint information, and one or more alert parameters as variables to the alert generating function. By establishing the DAT 314, an alert may be presented to the pilot advising him or her that, if corrective spacing action is not taken, he or she may anticipate and/or expect the controller to take an interventional action. It should be noted that, although the DAT 314 is shown as less than the CIT 310 but greater than the NTB 306, it could be less than the NSB 306 if the alert generating function makes such determination after one or more alert parameters have been applied.

The position of ownship 308 with respect to the positions of target waypoint 302 and the DAT 314 as illustrated in FIG. 6A may be presented on a visual display unit. Referring to FIG. 6B, the relative positions of the target waypoint 302 and ownship 308 are depicted on the visual display unit along with the intended flight path 316 of ownship 308 comprised of the target waypoint 302 and two waypoints 318 and 320, where such depictions could be generated from data representative of the positions of the intended flight path 316 and ownship 308. As embodied herein, the target waypoint 302 may be any waypoint of the intended flight path 316 and not necessarily the next waypoint (waypoint 318 of FIG. 6B).

For the purpose of illustration and not limitation, assume the following values have been assigned in a TM clearance to ownship 308 of FIG. 6B. Assume that the current time is 1530 Z and that a TM clearance has been assigned to ownship 308 which clears ownship 308 to cross target waypoint 302 at 1600 Z. This means that the assigned trajectory goal 304 is 30 minutes (the difference between 1600 Z and 1530 Z). Also, assume that an NTB 306 of +/−1 minute and a CIT 310 of +/−2.5 minutes have been assigned. In addition, assume that a trajectory interval 312 has been determined to be 29.5 minutes based upon a distance between the target waypoint 302 and ownship 308 and the speed of ownship 308. After applying the TM clearance information, ownship information, target waypoint information, and one or more alert parameters, assume that the DAT 314 has been determined by an alert generating function to be +/−2 minutes. Because the position of ownship 308 falls in between the boundaries of the DAT 314, no CIT advisory information comprised of a first-level or second-level alert is presented on a unit of the presentation system 160.

The drawings of FIG. 7 provide an example of a target waypoint 322, an assigned trajectory goal 324, NTB 326, ownship 328, a CIT 330, a trajectory interval 332, a DAT 334, a forward boundary of the DAT 334-A, an aft boundary of the DAT 334-B, and an intended flight path 336 comprised of the target waypoint 322 in between waypoints 338 and 340. In this example, ownship 328 is depicted as intersecting the forward boundary of the DAT 334-A, i.e., the position of ownship 328 intersects the position of the forward boundary of the DAT 334-A.

For the purpose of illustration and not limitation, assume the same values discussed for FIG. 6B have been assigned in a TM clearance to ownship 328 of FIG. 7B with the exception of the trajectory interval 332; assume that a trajectory interval 332 has been determined to be 28.0 minutes based upon a distance between the target waypoint 322 and ownship 328 and the speed of ownship 328. Because the position of ownship 328 intersects the forward boundary of the DAT 334, CIT visual advisory information comprised of textual and/or non-textual information corresponding to a first-level alert may be generated.

As shown in FIG. 7B, textual information comprised of the text message "TRAJECTORY—TOO FAST TO TARGET WP" and non-textual information comprised of a graphical object of a bracket coinciding with the forward boundary of the DAT 342 are presented on a visual display unit of the presentation system 160. As stated in the discussion above, the visual information could be presented in amber or yellow indicative of a caution alert. Visual advisory information is not limited to the text message and/or the graphical object shown in FIG. 7B but may be any text message and/or graphical object which conveys to the pilot information that ownship 328 has met or exceeds the DAT 334. Additionally, visual advisory information is not limited to being presented on a strategic display unit as shown in FIG. 7B; for example, visual advisory information could be presented on the tactical display unit(s) 164 shown in the drawings of FIGS. 2A and 2B. In an additional and/or alternative embodiment, CIT aural advisory information such as "CAUTION—TRAJECTORY TOO FAST TO TARGET WAYPOINT" may be presented through an aural alerting unit and/or tactile advisory information may be presented through a tactile alerting. It should be noted that applicable advisory information (i.e., too slow) could be presented if the position of ownship 328 had intersected the position of the aft boundary of the DAT 334.

The drawings of FIG. 8 provide an example of a target waypoint 352, an assigned trajectory goal 354, NTB 356, ownship 358, a CIT 360, a trajectory interval 362, a DAT 364, a forward boundary of the DAT 364-A, an aft boundary of the DAT 364-B, and an intended flight path 366 comprised of the target waypoint 352 in between waypoints 368 and 370. In this example, ownship 358 is depicted as intersecting the CIT 360, i.e., the position of ownship 358 intersects the position of the aft boundary of the CIT 360.

For the purpose of illustration and not limitation, assume the same values discussed for FIG. 6B have been assigned in a TM clearance to ownship 358 of FIG. 8B with the exception of the trajectory interval 362; assume that a trajectory interval 362 has been determined to be 32.5 minutes based upon a distance between the target waypoint 352 and ownship 358 and the speed of ownship 358. Because the position of ownship 358 has exceeded the aft boundary of the DAT 364-B and now intersects the aft boundary of the CIT 360, visual advisory information comprised of textual and/or non-textual information corresponding to a second-level alert may be generated.

As shown in FIG. 8B, textual information comprised of the text message "TRAJECTORY—TOO SLOW TO TARGET WP" and non-textual information comprised of a graphical object of a bracket coinciding with the aft boundary of the DAT 372 are presented on a visual display unit of the presentation system 160. To distinguish the presentation of the second-level alert with the presentation of the first-level alert, the visual information could be presented in red indicative of a warning alert. In an additional and/or alternative embodiment, CIT aural advisory information such as "WARNING—TRAJECTORY TOO SLOW TO TARGET WAYPOINT" may be presented through an aural alerting unit and/or tactile advisory information may be presented through a tactile alerting. It should be noted that similar but applicable advisory information (i.e., too fast) could be presented if the position of ownship 358 had intersected the position of the forward boundary of the CIT 360.

Besides a time-based trajectory goal, a TM clearance may also be comprised of lateral and vertical components defined by a three-dimensional intended flight plan between a plurality of waypoints. If so, lateral and/or vertical NTBs corresponding to lateral and/or vertical tolerances could be established about the intended flight path, where each NTB could be based upon a distance related to operational goals that are set by a ANSP for a specific TM operation. Also, lateral and/or vertical CITs could be established which, if met or exceeded by ownship deviating too far from the intended flight path laterally and/or vertically, may cause the controller to intervene in the TM operation. In addition, lateral and/or vertical DATs may be established for the purpose of preventing an intervening action by the controller is ownship meets or exceeds the established lateral and/or vertical CITs; in the same fashion as disclosed above, the lateral and/or vertical DATs may be established using a configurable alert generating function.

For the purpose of illustration and not limitation, assume the following values corresponding to lateral components of a TM clearance have been assigned to ownship. Assume that a lateral NTB of +/−0.25 nautical mile ("NM") has been assigned, a lateral CIT of +/−1.0 NM has been assigned, and a lateral DAT has been determined by an alert generating function to be +/−0.75 NM. If the position of ownship is determined to be 0.50 NM left or right of the intended flight path, then ownship falls in between the lateral boundaries of the DAT, and no CIT advisory information is presented on a unit of the presentation system 160. If the position of ownship is determined to be 0.75 NM left or right of the intended flight path, then ownship has intersected the left or right lateral boundary of the DAT; if so, then applicable visual, aural, and/or tactile CIT advisory information commensurate to this first level of threat could be presented. If the position of ownship is determined to be 1.0 NM left or right of the intended flight path, then ownship has intersected the left or right lateral boundary of the CIT, if so, then applicable visual, aural, and/or tactile CIT advisory information commensurate to this second level of threat could be presented.

In addition to the preceding illustration involving lateral components of a TM clearance, assume the following values corresponding to vertical components of a TM clearance have been assigned to ownship. Assume that a vertical NTB of +/−100 feet has been assigned, a vertical CIT of +/−500 feet has been assigned, and a vertical DAT has been determined by an alert generating function to be +/−400 feet. If the position of ownship is determined to be 300 feet above or below the intended flight path, then ownship falls in between top and bottom vertical boundaries of the DAT, and no CIT advisory information is presented on a unit of the presentation system 160. If the position of ownship is determined to be 400 feet above or below the intended flight path, then ownship has intersected the top or bottom vertical boundary of the DAT; if so, then applicable visual, aural, and/or tactile CIT advisory information commensurate to this first level of threat could be presented. If the position of ownship is determined to be 500 feet above or below of the intended flight path, then ownship has intersected the top or bottom vertical boundary of the CIT; if so, then applicable visual, aural, and/or tactile CIT advisory information commensurate to this second level of threat could be presented.

It should be noted that the components of a TM operation may be applied to clearances corresponding to assigned runway approach procedure clearances. For example, the target waypoint could be a landing threshold point of a published runway approach procedure. If target waypoint information is not provided by the ANSP in the approach clearance, then the identifier of the approach procedure (i.e., operation designator) may be used to retrieve waypoint information of the target waypoint (e.g., the landing threshold point) from a database storing approach procedure information such as, but not limited to, the navigation database of an FMC system. If CIT information is not provided in the approach clearance, the TA generator 150 could be configured with the algorithm(s) employed in a ground-based tool(s) to determine the CIT applied by the ANSP based upon the approach procedure, where the CIT may depend on the operation designator. For example, if the operation designator corresponds to an approach procedure used where parallel runway operations occur, the CIT may be reduced. This could affect the DAT as determined by the alert generating function.

In an embodiment of FIG. 9, flowchart 400 depicts a method for presenting controller intervention threshold advisory information in an aircraft, where the TA generator 150 may be programmed or configured with instructions corresponding to the following modules embodied in the flowchart. Also, TA generator 150 may be a processor of a module such as, but not limited to, a printed circuit board having one or more input interfaces to facilitate the two-way data communications of the TA generator 150, i.e., to facilitate the receiving and providing of data. As necessary for the accomplishment of the following modules embodied in the flowchart, the receiving of data is synonymous and/or interchangeable with the retrieving of data, and the providing of data is synonymous and/or interchangeable with the making available or supplying of data.

Flowchart 400 begins with module 402 with the receiving of clearance data from the clearance data source 130. In one embodiment, the clearance data could be a spacing clearance; in another embodiment, the clearance data could be a trajectory clearance. Spacing clearance data may include data representative of at least CIT information of a spacing clearance assigned to ownship, and trajectory clearance data may include data representative of at least CIT information of a trajectory clearance assigned to ownship. In either clearance, such CIT information could be comprised of the actual CIT of the clearance and/or an operation designator from which the actual CIT of the clearance assigned to ownship may be determined.

The flowchart continues with module 404 with the receiving ownship data representative of at least ownship position from a source of ownship data. The flowchart continues with module 406 with the receiving target data from the target data source 120. In one embodiment, the target data may be target aircraft data representative of target aircraft information. In another embodiment, the target data may be target waypoint data representative of target waypoint information. As embodied herein, the clearance data source 130 and the target data source 120 could be the same source where a spacing clearance has been assigned and/or the clearance data source 130 and the ownship data source 110 could be the same source where a trajectory clearance has been assigned.

The flowchart continues with module 408 with the receiving alert parameter data representative of at least one alert parameter from at least one source of alert parameter data. As embodied herein, the source of alert parameter data could include the ownship data source 110, the target data source 120, and/or the clearance data source 130.

The flowchart continues with module 410 with the determining of a DAT as a function of the clearance data, the ownship data, the target aircraft data, and the alert parameter data. The flowchart continues with module 412 with the generating an advisory data set if the ownship position meets or exceeds the DAT. The generated advisory data set could be representative of advisory information applicable for one or more units of a presentation system. In one embodiment, the advisory information could be comprised of advisory information corresponding to a first level of threat and/or advisory information corresponding to a second level of threat. Moreover, the advisory information could be comprised of visual advisory information, where such visual advisory information could be comprised of textual information and/or non-textual information. Also, the advisory information could be comprised of aural advisory information and/or tactile advisory information.

The flowchart continues with module 414 with the providing the advisory data set to one or more units of the presentation system. If the advisory information is comprised of visual advisory information, then such information could be presented on a visual display unit(s). If the advisory information is comprised of aural advisory information, then such information could be presented on an aural alerting unit(s). If the advisory information is comprised of tactile advisory information, applicable to a tactile alerting unit. Then the flowchart proceeds to the end.

It should be noted that the method steps described above may be embodied in computer-readable media as computer instruction code. It shall be appreciated to those skilled in the art that not all method steps described must be performed, nor must they be performed in the order stated.

As used herein, the term "embodiment" means an embodiment that serves to illustrate by way of example but not limitation.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

What is claimed is:

1. A system for generating at least one presentable clearance-dependent advisory, such system comprising:
- a source of clearance data comprised of a first aircraft system;
- a source of ownship data comprised of a second aircraft system;
- a source of target data comprised of a third aircraft system;
- a source of alert parameter data comprised of at least one fourth aircraft system;
- a threshold advisory generator configured to
  - receive clearance data representative of an air traffic controller intervention threshold information of a clearance assigned to ownship,
  - receive ownship data representative of at least ownship position,
  - receive target data corresponding to the clearance data,
  - receive alert parameter data representative of at least one alert parameter,
  - determine a dynamic alerting threshold as a function of
    - the air traffic controller intervention threshold information of the clearance data,
    - the ownship data,
    - the target data, and
    - the alert parameter data,
  - generate an advisory data set if the ownship position meets or exceeds the dynamic alerting threshold but precedes the air traffic controller intervention threshold, where
    - the advisory data set is
      - representative of at least one advisory corresponding to a level of threat, where
        - a first advisory is comprised of a visual advisory,
        - a second advisory is comprised of an aural advisory, and
        - a third advisory is comprised of a tactile advisory, and
  - provide the advisory data set to a presentation system; and
- the presentation system configured to
  - receive the advisory data set, and
  - provide the advisory data set to at least one unit, whereby
    - the first advisory is presented on at least one visual display unit if the first advisory is represented in the advisory data set,
    - the second advisory is presented through at least one aural alerting unit if the second advisory is represented in the advisory data set, and
    - the third advisory is presented through at least one tactile alerting unit if the third advisory is represented in the advisory data set.

2. The system of claim 1, wherein
- the clearance data is comprised of
  - spacing clearance data representative of at least controller intervention threshold information of a spacing clearance assigned to ownship, or
  - trajectory clearance data representative of at least controller intervention threshold information of a trajectory clearance assigned to ownship.

3. The system of claim 1, wherein
- the target data is comprised of
  - target aircraft data representative of target aircraft information, or
  - target waypoint data representative of target waypoint information.

4. The system of claim 1, wherein
- the first aircraft system and the second aircraft system are the same aircraft system,
- the first aircraft system and the third aircraft system are the same aircraft system, or
- both.

5. The system of claim 1, wherein
- the at least one fourth aircraft system is comprised of
  - the first aircraft system,
  - the second aircraft system, or
  - both.

6. The system of claim 1, wherein the controller intervention threshold information is comprised of the actual controller intervention threshold of a clearance assigned to ownship.

7. The system of claim 1, wherein the controller intervention threshold information is comprised of an operation designator from which the actual controller intervention threshold of a clearance assigned to ownship is determined.

8. The system of claim 1, wherein
- the visual advisory information is comprised of
  - textual information,
  - non-textual information, or
  - both.

9. A module for generating at least one presentable clearance-dependent advisory, such module comprising:
- a physical communications interface configured to facilitate two-way communications between at least one aircraft system and a threshold advisory generator; and the threshold advisory generator configured to receive clearance data representative of an air traffic intervention threshold information of a clearance assigned to ownship, receive ownship data representative of at least ownship position, receive target data corresponding to the clearance data, receive alert parameter data representative of at least one alert parameter, determine a dynamic alerting threshold as a function of the air traffic controller intervention threshold information of the clearance data, the ownship data, the target data, and the alert parameter data, generate an advisory data set if the ownship position meets or exceeds the dynamic alerting threshold but precedes the air traffic controller intervention threshold, where such advisory data set is representative of at least one advisory corresponding to a level of threat, where a first advisory is comprised of a visual advisory, a second advisory is comprised of an aural advisory, and a third advisory is comprised of a tactile advisory, and provide the advisory data set to a presentation system, whereby the first advisory is presentable on at least one visual display unit if the first advisory is represented in the advisory data set, the second advisory is presentable through at least one aural alerting unit if the second advisory is represented in the advisory data set, and the third advisory is presentable through at least one tactile alerting unit if the third advisory is represented in the advisory data set.

10. The module of claim 9, wherein the clearance data is comprised of spacing clearance data representative of at least controller intervention threshold information of a spacing clearance assigned to ownship, or trajectory clearance data representative of at least controller intervention threshold information of a trajectory clearance assigned to ownship.

11. The module of claim 9, wherein the target data is comprised of target aircraft data representative of target aircraft information, or target waypoint data representative of target waypoint information.

12. The module of claim 9, wherein the controller intervention threshold information is comprised of the actual controller intervention threshold of a clearance assigned to ownship.

13. The module of claim 9, wherein the controller intervention threshold information is comprised of an operation designator from which the actual controller intervention threshold of a clearance assigned to ownship is determined.

14. The module of claim 9, wherein the visual advisory information is comprised of textual information, non-textual information, or both.

15. A method for generating at least one presentable clearance-dependent advisory, such method comprising:

receiving clearance data representative of an air traffic controller intervention threshold information of a clearance assigned to ownship from a source of clearance data a first aircraft system;

receiving ownship data representative of at least ownship position from an source of ownship data a second aircraft system;

receiving target data corresponding to the clearance data from a source of target data a third aircraft system;

receiving alert parameter data representative of at least one alert parameter from at least one source of alert parameter data a fourth aircraft system;

determining a dynamic alerting threshold as a function of the air traffic controller intervention threshold information of the clearance data, the ownship data, the target data, and the alert parameter data;

generating an advisory data set if the ownship position meets or exceeds the dynamic alerting threshold but precedes the air traffic controller intervention threshold, where such advisory data set is representative of at least one advisory corresponding to a level of threat, where a first advisory is comprised of a visual advisory, a second advisory is comprised of an aural advisory, and a third advisory is comprised of a tactile advisory; and providing the advisory data set to a presentation system, whereby the first advisory is presentable on at least one visual display unit if the first advisory is represented in the advisory data set, the second advisory is presentable through at least one aural alerting unit if the second advisory is represented in the advisory data set, and the third advisory is presentable through at least one tactile alerting unit if the third advisory is represented in the advisory data set.

16. The method of claim 15, wherein the clearance data is comprised of spacing clearance data representative of at least controller intervention threshold information of a spacing clearance assigned to ownship, or trajectory clearance data representative of at least controller intervention threshold information of a trajectory clearance assigned to ownship.

17. The method of claim 15, wherein the target data is comprised of target aircraft data representative of target aircraft information, or target waypoint data representative of target waypoint information.

18. The method of claim 15, wherein the controller intervention threshold information is comprised of the actual controller intervention threshold of a clearance assigned to ownship.

19. The method of claim 15, wherein the controller intervention threshold information is comprised of an operation designator from which the actual controller intervention threshold of a clearance assigned to ownship is determined.

20. The method of claim 15, wherein
the visual advisory information is comprised of
textual information,
non-textual information, or
both.

* * * * *